US009360244B2

(12) United States Patent
Hashimoto et al.

(10) Patent No.: US 9,360,244 B2
(45) Date of Patent: Jun. 7, 2016

(54) ENGINE DRIVEN HEAT PUMP

(71) Applicant: YANMAR CO., LTD., Osaka (JP)
(72) Inventors: Kyoko Hashimoto, Osaka (JP); Shohei Amakawa, Osaka (JP); Masaya Horibe, Osaka (JP)
(73) Assignee: YANMAR CO., LTD., Osaka-shi (JP)

( * ) Notice: Subject to any disclaimer, the term of this patent is extended or adjusted under 35 U.S.C. 154(b) by 0 days.
(21) Appl. No.: 14/561,773
(22) Filed: Dec. 5, 2014
(65) Prior Publication Data
US 2015/0184913 A1 Jul. 2, 2015
(30) Foreign Application Priority Data
Dec. 27, 2013 (JP) ..... 2013-272910
(51) Int. Cl.
*H02P 1/28* (2006.01)
*F25B 49/02* (2006.01)
*F25B 27/00* (2006.01)
*F25B 31/02* (2006.01)
(52) U.S. Cl.
CPC ..... *F25B 49/025* (2013.01); *F25B 27/00* (2013.01); *F25B 31/02* (2013.01)
(58) Field of Classification Search
CPC ..... H01M 10/6566; H01M 10/663; H01M 2250/10; H01M 2250/20; H01M 2250/402; H01M 8/04089; H01M 8/04126; H01M 8/04156; H01M 8/4201; H01M 8/04253; H01M 8/04261; H01M 8/0656; H02P 29/0044; F25B 49/025; F25B 27/00; F25B 31/02
USPC ..... 318/139, 400.15, 471, 504; 180/65.285, 180/65.265; 70/22
See application file for complete search history.

(56) References Cited

U.S. PATENT DOCUMENTS 4,280,330 A * 7/1981 Harris ..... B60H 1/00478 123/198 R
5,031,690 A * 7/1991 Anderson ..... B60H 1/3226 165/43
5,088,646 A * 2/1992 Yamagishi ..... F24D 15/04 237/2 B
5,629,568 A * 5/1997 Mertens ..... B60H 1/3208 290/40 R
7,259,664 B1 * 8/2007 Cho ..... B60L 11/126 180/65.265
7,443,139 B2 * 10/2008 Mitsui ..... G01R 31/3624 320/132
7,495,417 B2 * 2/2009 Ishishita ..... G01R 31/3658 320/134
7,629,530 B2 * 12/2009 Inaoka ..... B60H 1/004 136/205
7,789,794 B2 * 9/2010 Hong ..... B60K 1/00 180/65.285
8,138,711 B2 * 3/2012 Hwang ..... H02P 29/0044 318/471
8,299,800 B2 * 10/2012 Tsujiko ..... G01R 31/36 320/165
2002/0084769 A1 * 7/2002 Iritani ..... B60H 1/3208 320/104
2005/0247336 A1 * 11/2005 Inaoka ..... B60H 1/004 136/205
2005/0269991 A1 * 12/2005 Mitsui ..... G01R 31/3624 320/132
2006/0208708 A1 * 9/2006 Ishishita ..... G01R 31/3658 320/166
2009/0092501 A1 * 4/2009 Seibel ..... F04B 35/04 417/44.1
2009/0102405 A1 * 4/2009 Hwang ..... H02P 29/0044 318/400.15
2011/0070100 A1 * 3/2011 McSweeney ..... F04B 35/04 417/53
2011/0133721 A1 * 6/2011 Tsujiko ..... G01R 31/36 324/74
2013/0211649 A1 * 8/2013 Tashiro ..... B60H 1/00735 701/22
2013/0211650 A1 * 8/2013 Tashiro ..... B60W 10/06 701/22
2015/0075198 A1 3/2015 Amakawa et al.

FOREIGN PATENT DOCUMENTS

JP 4682558 B2 5/2011
JP 2015-059688 A 3/2015

* cited by examiner

*Primary Examiner* — Paul Ip
(74) *Attorney, Agent, or Firm* — Locke Lord LLP

(57) ABSTRACT

An engine driven heat pump includes a temperature switch that opens and closes in accordance with the peripheral temperature of an inverter and a control device that includes a signal reception unit, and a temperature open contact point that opens at a predetermined temperature or higher is provided in the temperature switch, and an abnormal-time open contact point that opens when abnormality occurs in a battery charging circuit is provided in the battery charging circuit, and a signal generation contact point that generates a state signal indicating a state of the inverter is provided in the inverter, and the temperature open contact of point the temperature switch, the abnormal-time open contact point of the battery charging circuit, and the signal generation contact point of the inverter are connected in series with respect to the signal reception unit of the control device.

2 Claims, 7 Drawing Sheets

ENGINE DRIVEN HEAT PUMP

CROSS REFERENCE TO RELATED APPLICATIONS

This application is related to co-pending applications: "ENGINE DRIVEN HEAT PUMP" filed even date herewith in the names of Hideshi Okada and Kyoko Hashimoto, which claims priority to Japanese Application No. 2013-272908 filed Dec. 27, 2013 and "ENGINE DRIVEN HEAT PUMP" filed even date herewith in the names of Hideshi Okada and Kyoko Hashimoto, which claims priority to Japanese Application No. 2013-272909 filed Dec. 27, 2013 each of the above-identified applications is assigned to the assignee of the present application and is incorporated by reference herein.

INCORPORATION BY REFERENCE REGARDING APPLICATION AND PRIORITY

This nonprovisional application claims priority under U.S.C. 119(a) on Patent Application No. 2013-272910 filed in Japan on Dec. 27, 2013, the entire contents of which are hereby incorporated by reference.

BACKGROUND OF THE INVENTION

1. Field of the Invention

The present invention relates to an engine driven heat pump in which heat exchange is performed by use of a refrigerant, which is sucked and discharged by a compressor driven by an engine, thereby flowing through a refrigerant circuit.

2. Description of the Related Art

Conventionally, it has been known that a generator is mounted in the engine driven heat pump in which heat exchange is performed by use of a refrigerant, which is sucked and discharged by a compressor driven by the engine, thereby flowing through a refrigerant circuit (see, for example, Japanese Patent No. 4682558).

Japanese Patent No. 4682558 discloses that the engine driven heat pump, in which the generator is mounted, is used as a power supply device at the time of power failure.

However, Japanese Patent No. 4682558 discloses that the engine driven heat pump, in which the generator is mounted, is used as the power supply device at the time of power failure, Japanese Patent No. 4682558 fails to disclose any specific monitoring constitution in which the occurrence of abnormality in a self-sustaining device used at the time of a self-sustaining operation is monitored.

SUMMARY OF THE INVENTION

The present invention provides an engine driven heat pump, in which a generator is mounted, the engine driven heat pump configured to be used as a power supply device at the time of power failure and configured to provide monitoring constitution in which the occurrence of abnormality in a self-sustaining device used at the time of a self-sustaining operation is monitored.

According to one aspect of the present invention, an engine driven heat pump includes an engine, a compressor configured to be driven by the engine, a refrigerant circuit configured to flow a refrigerant sucked and discharged by the compressor, a generator configured to be driven by the engine, an engine actuation battery configured to actuate the engine, a battery charging circuit configured to charge the engine actuation battery, an inverter configured to convert output power from the generator into a predetermined voltage and a predetermined frequency, a temperature switch configured to open and close in accordance with a peripheral temperature of the inverter, and a control device configured to include a signal reception unit, wherein a temperature open contact point configured to be opened at a predetermined temperature or higher is provided in the temperature switch, and wherein an abnormal-time open contact point configured to be opened when abnormality occurs in the battery charging circuit is provided in the battery charging circuit, and wherein a signal generation contact point configured to generate a state signal indicating a state of the inverter is provided in the inverter, and wherein the temperature open contact point of the temperature switch, the abnormal-time open contact point of the battery charging circuit, and the signal generation contact point of the inverter are connected in series with respect to the signal reception unit of the control device.

According to another aspect of the present invention, a mode can be exemplified where the inverter generates a pulse signal having a predetermined cycle at a normal time as the state signal and generates a pulse signal having a predetermined cycle, which is different from the pulse signal at the normal time, corresponding to an abnormal state at an abnormal time as the state signal.

According to another aspect of the present invention, with respect to the engine driven heat pump, which includes a generator and is used as a power supply device at the time of power failure, the engine driven heat pump can provide monitoring constitution in which the occurrence of abnormality in a self-sustaining device used at the time of a self-sustaining operation is monitored.

DESCRIPTION OF THE PREFERRED EMBODIMENT

Hereinafter, the embodiment of the present invention will be described referring to drawings.

Figure 1:
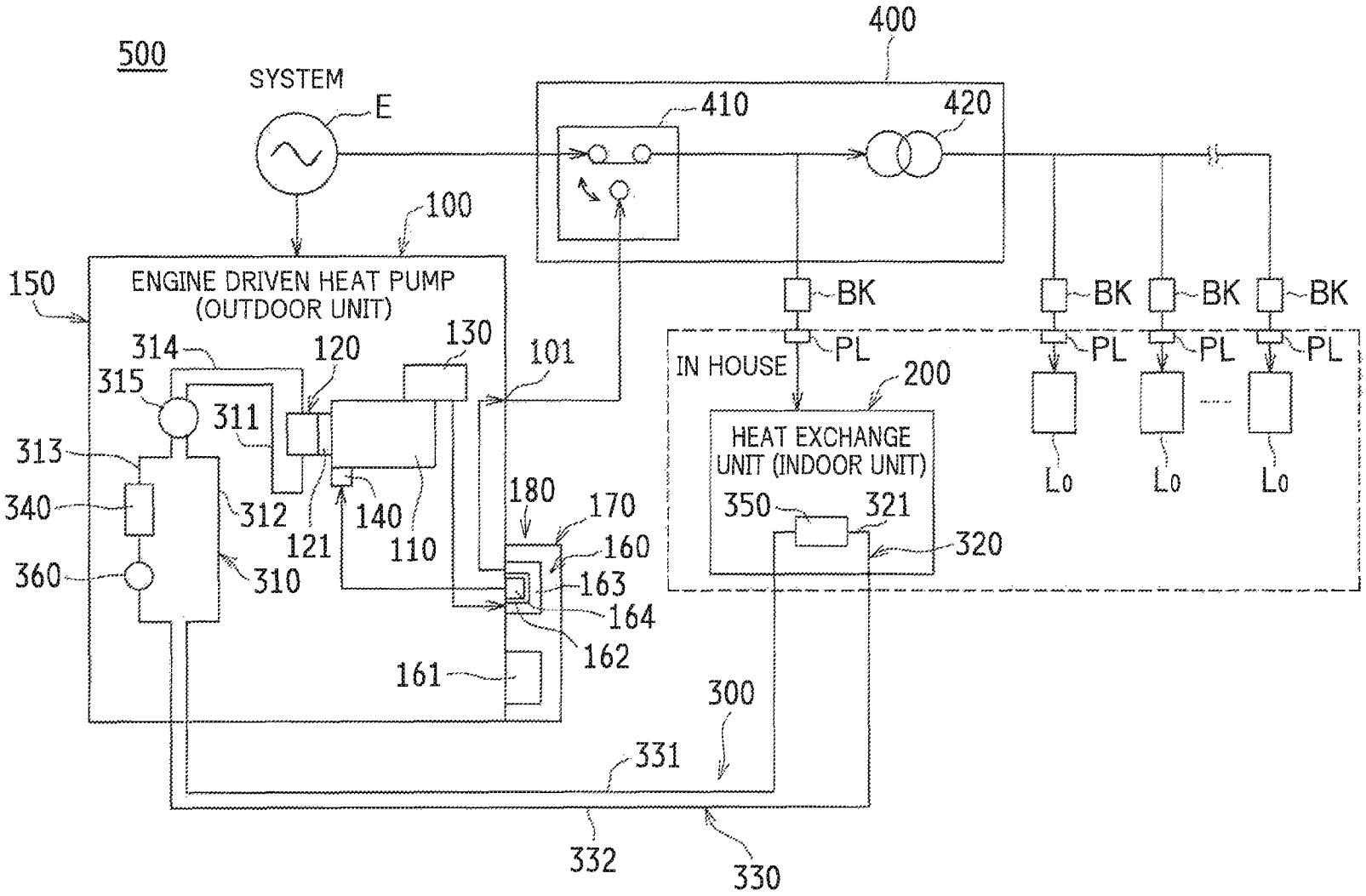
FIG. 1 is a schematic block diagram illustrating one example of a heat exchange system including an engine driven heat pump according to the embodiment of the present invention.

FIG. 1 is a schematic block diagram illustrating one example of a heat exchange system 500 including an engine driven heat pump 100 according to the embodiment of the present invention.

The heat exchange system 500 illustrated in FIG. 1 is provided in such a manner that a refrigerant is circulated through a refrigerant circulation path 300 while a state where the refrigerant is decompressed and brought down to a low temperature and a state where the refrigerant is pressurized and brought up to a high temperature are alternated by means of the engine driven heat pump 100.

The refrigerant circulation path 300 includes a first refrigerant circuit 310 (one example of a refrigerant circuit) provided in the engine driven heat pump 100 (an outdoor unit constituting an air conditioner in the example), a second refrigerant circuit 320 provided in a heat exchange unit 200 (an indoor unit constituting the air conditioner in the example), a third refrigerant circuit 330 with which the first refrigerant circuit 310 and the second refrigerant circuit 320 are communicated, a first heat exchanger 340 provided in the engine driven heat pump 100 and interposed in the first refrigerant circuit 310, a second heat exchanger 350 provided in the heat exchange unit 200 and interposed in the second refrigerant circuit 320, and an expansion valve 360 interposed in the refrigerant circuit (the first refrigerant circuit 310 in the example) provided between the first heat exchanger 340 and the second heat exchanger 350.

The first refrigerant circuit 310 of the engine driven heat pump 100 includes a discharge-side first refrigerant pipe 311 that is connected to a discharge side of a compressor 120 that is driven by an engine 110, thereby sucking and discharging the refrigerant, a one-side first refrigerant pipe 312 that is connected to one side of a third refrigerant pipe 331 on the one side of the third refrigerant circuit 330, an other-side first refrigerant pipe 313 that is connected to a third refrigerant pipe 332 on the other side of the third refrigerant circuit 330, an suction-side first refrigerant pipe 314 that is connected to the suction side of the compressor 120, and a four-way valve 315. The four-way valve 315 is connected to the discharge-side first refrigerant pipe 311, the one-side first refrigerant pipe 312, the other-side first refrigerant pipe 313, and the suction-side first refrigerant pipe 314, and the four-way valve 315 is switchable in such a manner that the refrigerant from the discharge-side first refrigerant pipe 311 is guided to the one-side first refrigerant pipe 312, and the refrigerant from the other-side first refrigerant pipe 313 is guided to the suction-side first refrigerant pipe 314, or in such a manner that the refrigerant from the discharge-side first refrigerant pipe 311 is guided to the other-side first refrigerant pipe 313, and the refrigerant from the one-side first refrigerant pipe 312 is guided to the suction-side first refrigerant pipe 314. The first heat exchanger 340 is provided in the other-side first refrigerant pipe 313, and the expansion valve 360 is provided between the first heat exchanger 340 and the third refrigerant pipe 332 on the other side of the third refrigerant circuit 330 with respect to the other-side first refrigerant pipe 313. The second refrigerant circuit 320 of the heat exchange unit 200 includes a second refrigerant pipe 321 connected to the third refrigerant pipe 331 on the one side of the third refrigerant circuit 330 and the third refrigerant pipe 332 on the other side of the third refrigerant circuit 330. The second heat exchanger 350 is provided in the second refrigerant pipe 321.

With the above-mentioned constitution, when the heat exchange system 500 is utilized for heating or hot-water supply (heating in the example), the four-way valve 315 is switched in such a manner that the refrigerant from the discharge-side first refrigerant pipe 311 is guided to the one-side first refrigerant pipe 312, and the refrigerant from the other-side first refrigerant pipe 313 is guided to the suction-side first refrigerant pipe 314, and the low-temperature refrigerant is brought into indirect contact with the open air or water via the first heat exchanger 340 so as to absorb heat, and further the refrigerant is compressed by the compressor 120 and brought up to a high temperature, and air in a room or water for hot-water supply (air in a room in the example) is heated via the second heat exchanger 350. In contrast, when the heat exchange system 500 is utilized for air conditioning or cold storage (air conditioning in the example), the four-way valve 315 is switched in such a manner that the refrigerant from the discharge-side first refrigerant pipe 311 is guided to the other-side first refrigerant pipe 313, and the refrigerant from the one-side first refrigerant pipe 312 is guided to the suction-side first refrigerant pipe 314, and the high-temperature refrigerant is brought into indirect contact with the open air and the like via the first heat exchanger 340 so as to discharge heat, and further the refrigerant is decompressed through the expansion valve 360 and brought down to a low temperature, and the air in the room or a refrigerator (the room in the example) is cooled via the second heat exchanger 350.

Also, regarding the heat exchange system 500, the engine driven heat pump 100, in which a generator 130 that outputs the output power based on the rotational drive of the engine 110 is mounted, is used as a power supply device at the time of power failure of a system E (specifically, commercial power supply), and the heat exchange system 500 further includes a self-sustaining switching device 400 that switches a system operation and a self-sustaining operation, which is performed at the time of power failure of the system E.

The self-sustaining switching device 400 includes a switching unit 410 that switches operations on whether the system E and wiring attachment connectors PL such as an attachment plug or a wall socket in a house are connected via wiring circuit breakers BK (breaker) or whether an independent output unit 101 of the engine driven heat pump 100 and the wiring attachment connectors PL in the house are connected via the wiring circuit breakers BK.

In the present embodiment, the switching unit 410 automatically switches from/to a system connection state where the system E and the wiring attachment connectors PL are connected when the system power is supplied from the system E to/from a power-failure connection state where the independent output unit 101 of the engine driven heat pump 100 and the wiring attachment connectors PL are connected when the power supply is cut off. It is noted that the switching unit 410 may switch the system connection state and the power-failure connection state in a manual manner.

Also, the self-sustaining switching device 400 further includes a transformer 420. The transformer 420 transforms 200V system voltage to 100V system voltage. The transformer 420 is provided on a connecting line between the wiring circuit breaker BK corresponding to the wiring attachment connector PL for the 200V system (connector connected to the heat exchange unit 200 in the example) and the wiring circuit breaker BK corresponding to the wiring attachment connector PL for the 100V system (in the example, a connector connected to a general load Lo such as an illuminator or a television set that is usually used).

In the present embodiment, regarding the engine driven heat pump 100, a main body package 150 stores the engine 110 (a gas engine in the example), the compressor 120 driven by the engine 110, the first refrigerant circuit 310 that flows the refrigerant sucked and discharged by the compressor 120, and the generator 130 driven by the engine 110. Specifically, a driving force from the engine 110 is transmitted to the compressor 120 via an electromagnetic clutch 121. The driving force from the engine 110 is transmitted to the generator 130 directly or indirectly via a driving transmission means not illustrated. It is noted that the engine 110 is provided as a gas engine, but not limited thereto. Engines except for the gas engine may be applied.

The engine driven heat pump 100 includes a self-sustaining power supply device 160 that includes an engine actuation battery 161 that supplies power to an engine starter 140 (specifically, a starter motor) for starting the engine 110 and actuates the engine 110, a battery charging circuit 162 (specifically, a battery charger) that charges the engine actuation battery 161, and an inverter 163 (specifically, a self-sustaining inverter) that converts the output power from the generator 130 into a predetermined voltage and a predetermined frequency. In the present embodiment, the self-sustaining power supply device 160 further includes a starter relay 164. The starter relay 164 is connected between the engine starter 140 and the engine actuation battery 161 and configured to supply battery power from the engine actuation battery 161 to the engine starter 140.

It is noted that the inverter 163 can switch two frequencies that are different from each other (specifically, 50 Hz or 60 Hz). Regarding the engine driven heat pump 100, the self-sustaining power supply device 160 is stored in a separate body package 170 that is separate from the main body package 150. A battery unit 180 is constituted by the self-sustaining power supply device 160 and the separate body package 170.

<Electric Circuit in Engine Driven Heat Pump>

Next, the electric circuit of the engine driven heat pump 100 according to the present embodiment will be described.

Figure 2:
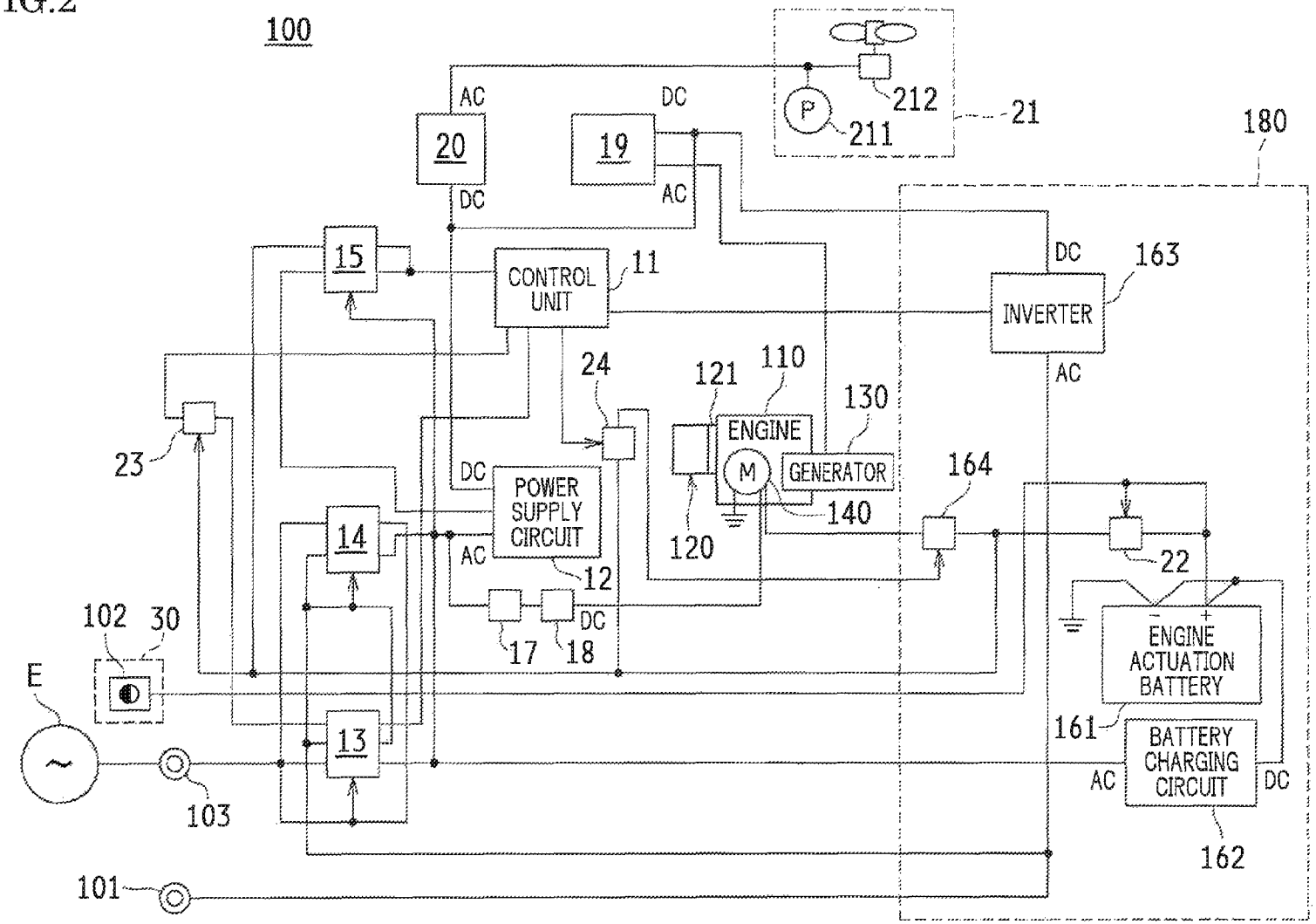
FIG. 2 is a block diagram illustrating the schematic constitution of the electric circuit of the engine driven heat pump according to the present embodiment.

FIG. 2 is a block diagram illustrating the schematic constitution of the electric circuit of the engine driven heat pump 100 according to the present embodiment.

As illustrated in FIG. 2, the engine driven heat pump 100 includes a control unit 11 (one example of a control device), a power supply circuit 12, a system cutoff relay 13, an independent power supply relay 14, and a self-sustaining switch 102, in addition to the engine 110, the compressor 120, the generator 130, the engine actuation battery 161, the battery charging circuit 162, the inverter 163, the starter relay 164, the engine starter 140, and the independent output unit 101, each of which is described above.

The control unit 11 gains the whole control of the engine driven heat pump 100 and constitutes a control board. The control unit 11 includes a processing unit (not illustrated) such as a Central Processing Unit (CPU) and a storage unit (not illustrated) that includes a nonvolatile memory such as Read Only Memory (ROM), a rewritable nonvolatile memory such as a flash memory, and a volatile memory such as Random Access Memory (RAM). In the engine driven heat pump 100, the processing unit of the control unit 11 loads a control program stored in advance in the ROM of the storage unit on the RAM of the storage unit and executes the control program, thereby controlling various constitutional elements. Also, various system information such as the operational parameters and setting data of the engine driven heat pump 100 is stored in the nonvolatile memory of the storage unit.

Then, the control unit 11 is configured to switch between an ordinary operational mode for driving the engine 110 in a case where a user's request (a user's instruction) for a heat pump operation (air conditioning in the example) is provided and a self-sustaining mode for driving the engine 110 irrespective of the request for the heat pump operation (air conditioning in the example).

The power supply circuit 12 supplies power to electric instruments (in the example, the control unit 11 and an ignition plug, not illustrated, of the engine 110) in the engine driven heat pump 100 and constitutes a power supply board. The power supply circuit 12 converts the input power of an alternating current into the output power of a direct current and serves as a power supply for the control unit 11 or as a power supply for the ignition plug of the engine 110 in the example.

The system cutoff relay 13 is configured to self-hold a closed state based on the power of the system E, connect to the system E, the power supply circuit 12, and the battery charging circuit 162, and supply the system power from the system 11 to the power supply circuit 12 and the battery charging circuit 162, whereas the system cutoff relay 13 is configured to fall into an open state at the time of power failure and cut off the connection between the system E, and the power supply circuit 12 and the battery charging circuit 162.

When the independent power supply relay 14 is connected in parallel with the system cutoff relay 13 with respect to the power supply circuit 12 and the battery charging circuit 162, and when the power from the system F is supplied, the independent power supply relay 14 is configured to fall into an open state and cut off the connection between the system cutoff relay 13, and the power supply circuit 12 and the battery charging circuit 162, whereas the independent power supply relay 14 is configured to self-hold a closed state based on the output power from the inverter 163 at the time of power failure, connect the inverter 163 with the power supply circuit 12 and the battery charging circuit 162, and supply the output power from the inverter 163 to the power supply circuit 12 and the battery charging circuit 162.

The self-sustaining switch 102 is configured to maintain an ON state based on a user's ON operation, whereas the self-sustaining switch 102 is configured to be turned of from the ON state based on the user's OFF operation and maintain an OFF state. More particularly, the self-sustaining switch 102 includes functions of manually switching the connection or cutoff between the engine actuation battery 161 and the control unit 11 only during the power failure and manually switching ON/OFF (presence and absence) of a self-sustaining signal that instructs the control unit 11 to perform a self-sustaining operation. It is noted that the self-sustaining switch 102 can be operated from a control panel 30 in a house.

In the present embodiment, the engine driven heat pump 100 further includes an input power supply relay 15.

The input power supply relay 15 is configured to supply the output power from the power supply circuit 12 to the control unit 11, whereas when the self-sustaining switch 102 is turned on at the time of power failure, the input power supply relay 15 is configured to supply the battery power from the engine actuation battery 161 to the control unit 11.

It is noted that members that are not described in FIG. 2 will be described in specific circuit constitution below.

<Regarding Specific Circuit Constitution>

Next, the specific circuit constitution of the engine driven heat pump 100 according to the present embodiment will be described referring to FIG. 3.

Figure 3:
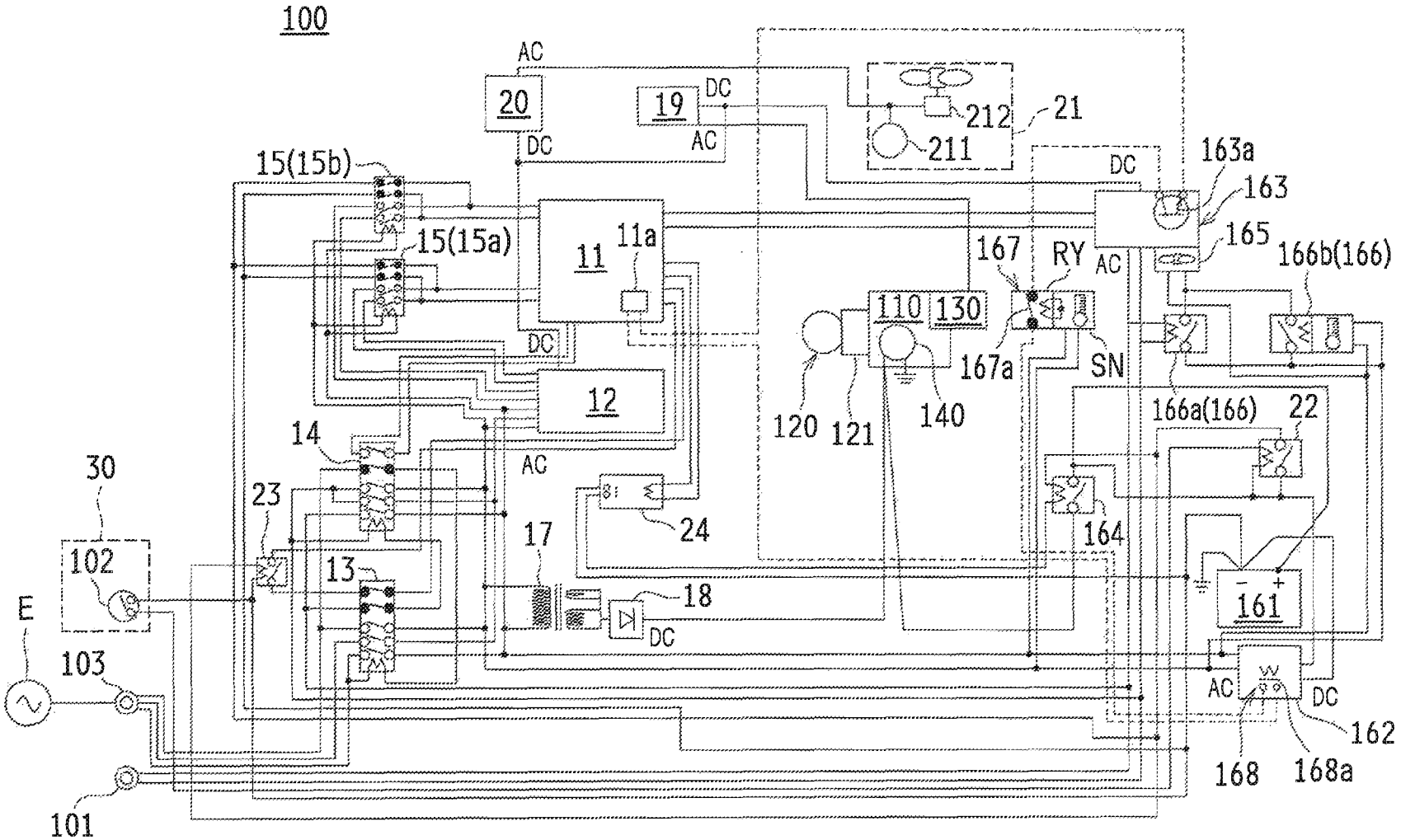
FIG. 3 is a detailed diagram of the electric circuit in the engine driven heat pump according to the present embodiment.

FIG. 3 is a detailed diagram of an electric circuit in the engine driven heat pump 100 according to the present embodiment.

(Circuit Constitution Regarding Circuit Operation when System Power is Supplied)

The system cutoff relay 13 includes an A contact point (○ illustrated in FIG. 3) at which the system cutoff relay 13 is conducted (closed) in an excited state where an exciting coil is excited and non-conducted (opened) in a non-excited state where the exciting coil is not excited and a B contact point (● illustrated in FIG. 3) at which the system cutoff relay 13 is non-conducted (opened) in the excited state and conducted (closed) in the non-excited state. Herein, the meaning of the A contact point or the B contact point is similarly applied to the independent power supply relay 14, the input power supply relay 15 (specifically, a control power supply relay 15*a* and an ignition power supply relay 15*b*), a battery relay 22 described later, a self-sustaining input relay 23, a starter relay 164, a control relay 24, the battery charging circuit 162, a cooling fan relay 166*a*, a cooling fan switch 166*b*, and a temperature switch 167.

The system cutoff relay 13 includes three A contact points (○) and two B contact points (●), and the independent power supply relay 14 includes four A contact points (○) and one B contact point (●). The input power supply relay 15 is constituted by the control power supply relay 15*a* and the ignition power supply relay 15*b*. The input power supply relay 15 (specifically, the control power supply relay 15*a* and the ignition power supply relay 15*b*) includes two A contact points (○) and two B contact points (●).

The engine driven heat pump 100 further includes a system input unit 103 connected to the system E, a starting transformer 17 that steps down the system voltage of the system E, a rectifier circuit 18 (specifically, a rectifier) that converts alternating current power from the starting transformer 17 into direct current power, a generator controller 19 that output-controls the output power (alternating current power) from the generator 130 and gains generation power (direct current power) required for power generation, and an internal instrument 21 (internal electric instrument) that includes an engine cooling water pump 211 and an outdoor fan 212 that are driven based on the generation power from the generator controller 19 via an internal instrument power converter 20. The internal instrument power converter 20 supplies the drive power (alternating current power), which is gained by converting the generation power (direct current power) from the generator controller 19, to the internal instrument 21 that includes the engine cooling water pump 211 and the outdoor fan 212. Herein, the generator controller 19 acts as a direct current stabilized power supply that output-controls the output voltage (alternating current voltage) from the generator 130 in such a manner that the output voltage from the generator 130 is held at a constant generation voltage (direct current voltage). The internal instrument power converter 20 acts as an internal instrument inverter that converts the generation power (direct current power) from the generator controller 19 into the drive power (alternating current power).

The system input unit 103 constitutes an external input terminal and inputs system power from the system E.

The system input unit 103 is connected to the alternating current side of the power supply circuit 12, the input side of the starting transformer 17, the exciting coil of the input power supply relay 15 (specifically, the control power supply relay 15*a* and the ignition power supply relay 15*b*), and the input side of the battery charging circuit 162 via the three A contact points (○) of the system cutoff relay 13. Also, the system input unit 103 is connected to the exciting coil of the system cutoff relay 13 via one B contact point (●) of the independent power supply relay 14.

The output side of the starting transformer 17 is connected to the engine starter 140 via the rectifier circuit 18.

The power supply input port (specifically, a control power supply port and an ignition power supply port) of the control unit 11 is connected to the direct current side of the power supply circuit 12 via the two A contact points (○) of the input power supply relay 15 (specifically, the control power supply relay 15*a* and the ignition power supply relay 15*b*).

Also, the direct current side of the power supply circuit 12 and the direct current side of the generator controller 19 are connected to the internal instrument 21 via the internal instrument power converter 20. The alternating current side of the generator controller 19 is connected to the generator 130.

Furthermore, the output side of the battery charging circuit 162 is connected to the engine actuation battery 161.

It is noted that, although not illustrated, an earth leakage breaker (ELB: Earth Leakage circuit Breaker) is connected between the system input unit 103, and the system cutoff relay 13 and the independent power supply relay 14. A starter relay whose operation is controlled by the control unit 11 is connected between the rectifier circuit 18 and the engine starter 140. A power-failure capacitor is connected in the middle of the line between the two A contact points (○) disposed between the control power supply relay 15*a* and the control power supply port of the control unit 11. A generator reactor is connected between the generator 130 and the input side of the generator controller 19.

(Circuit Constitution Regarding Circuit Operation when System Power is Cut Off)

The engine driven heat pump 100 further includes the battery relay 22, the self-sustaining input relay 23, and the control relay 24.

The battery relay 22 is configured to cut off the connection between the engine actuation battery 161 and the exciting coil of the self-sustaining input relay 23, whereas when the self-sustaining switch 102 is turned on by a user, the battery relay 22 is configured to supply the battery power from the engine actuation battery 161 to the exciting coil of the self-sustaining input relay 23.

The self-sustaining input relay 23 is configured to cut off the conduction of the self-sustaining instruction port of the control unit 11. Whereas when the battery power from the engine actuation battery 161 is supplied to the exciting coil via the battery relay 22, the self-sustaining input relay 23 is configured to bring the self-sustaining instruction port of the control unit 11 into conduction. Herein, when the self-sustaining instruction port is conducted, and the control unit 11 receives a self-sustaining signal, the control unit 11 can recognize that the self-sustaining switch 102 is turned on by the user, and that the self-sustaining operation is instructed, whereby the control unit 11 can switch operational modes to a self-sustaining mode.

The control relay 24 is configured to cut off the connection between the engine actuation battery 161 and the exciting coil of the starter relay 164, whereas when engine starting power from the control unit 11 is supplied to the exciting coil, the control relay 24 is configured to supply the battery power from the engine actuation battery 161 to the exciting coil of the starter relay 164.

The starter relay 164 is configured to cut off the connection between the engine actuation battery 161 and the engine starter 140, whereas when the battery power from the engine actuation battery 161 is supplied to the exciting coil via the control relay 24, the starter relay 164 is configured to supply the battery power from the engine actuation battery 161 to the engine starter 140.

Specifically, any of the battery relay 22, the self-sustaining input relay 23, the control relay 24, and the starter relay 164 includes one A contact point (○).

The exciting coil of the battery relay 22 is connected to the engine actuation battery 161 via the self-sustaining switch 102.

The exciting coil of the self-sustaining input relay 23 is connected to the engine actuation battery 161 via the A contact point (○) of the battery relay 22. The self-sustaining instruction port of the control unit 11 is connected via the A contact point (○) of the self-sustaining input relay 23 and one B contact point (●) of the system cutoff relay 13 and constitutes a closed circuit of the self-sustaining signal.

The exciting coil of the control relay 24 is connected to the engine starting output port of the control unit 11.

The exciting coil of the starter relay 164 is connected to the engine actuation battery 161 via the A contact point (○) of the control relay 24 and the A contact point (○) of the battery relay 22. The engine starter 140 is connected to the engine actuation battery 161 via the A contact point (○) of the starter relay 164.

The power supply input port (specifically, the control power supply port and the ignition power supply port) of the control unit 11 is connected to the engine actuation battery 161 via the two B contact points (●) of the input power supply relay 15 (specifically, the control power supply relay 15*a* and the ignition power supply relay 15*b*) and the A contact point (○) of the battery relay 22.

The signal input side of the inverter 163 is connected to the inverter output instruction port of the control unit 11.

Furthermore, the direct current side of the generator controller 19 is connected to the input side (direct current side) of the inverter 163.

Herein, although not illustrated, a fuse is connected between the A contact point (○) of the starter relay 164 and the exciting coil of the battery relay 22, and between the B contact point (●) of the input power supply relay 15 (specifically, the control power supply relay 15*a* and the ignition power supply relay 15*b*) and the A contact point (○) of the battery relay 22. The fuse and a battery switch are connected in series between the self-sustaining switch 102 and the exciting coil of the battery relay 22. The fuse and an independent actuation display lamp, which are disposed in parallel to the self-sustaining input relay 23, are connected in series between the terminals of the exciting coil of the self-sustaining input relay 23.

It is noted that other circuit constitution with regard to the circuit constitution regarding circuit operations at the time of power failure has been described. Accordingly, its description is omitted.

(Circuit Constitution Regarding Circuit Operation in Self-Sustaining Operation)

When the output power from the inverter 163 is received after the establishment of the voltage of the generator 130, the engine driven heat pump 100 is configured to supply the output power from the inverter 163 to the power supply circuit 12 and the battery charging circuit 162 by means of the independent power supply relay 14 and supply the output power from the inverter 163 to the outside of the engine driven heat pump 100 via the independent output unit 101.

Also, while the output power from the inverter 163 is being supplied, the engine driven heat pump 100 is configured to maintain, the cutoff of the connection between the system E, and the power supply circuit 12 and the battery charging circuit 162 by means of the system cutoff relay 13 and maintain the output power from the inverter 163 until the self-sustaining signal is interrupted.

Also, when the power is restored, and the output power from the inverter 163 is interrupted, the engine driven heat pump 100 is configured to restore the connection between the system E, and the power supply circuit 12 and the battery charging circuit 162 by means of the system cutoff relay 13.

In the present embodiment, when the output power from the inverter 163 is interrupted, the engine driven heat pump 100 is configured to cut off the connection between the inverter 163, and the power supply circuit 12 and the battery charging circuit 162 by means of the independent power supply relay 14.

More particularly, the independent output unit 101 is connected in parallel to the independent power supply relay 14 with respect to the inverter 163 and constitutes external output terminals. The independent output unit 101 is connected to the switching unit 410 illustrated in FIG. 1 and configured to supply the output power from the inverter 163 to the switching unit 410.

When the output power from the inverter 163 is supplied to the exciting coil, the independent power supply relay 14 is configured to supply the output power from the inverter 163 to the power supply circuit 12 and the battery charging circuit 162, and the inverter output confirmation port of the control unit 11 is conducted. Herein, when the inverter output confirmation port is conducted, and the inverter output signal is received, the control unit 11 can recognize that the output power from the inverter 163 is outputted.

Specifically, the output side (alternating current side) of the inverter 163 is connected to the alternating current side of the power supply circuit 12, the input side of the starting transformer 17, the exciting coil of the input power supply relay 15 (specifically, the control power supply relay 15*a* and the ignition power supply relay 15*b*), and the input side of the battery charging circuit 162 via three A contact points (○) of the independent power supply relay 14. Also, the output side of the inverter 163 is connected to the independent output unit 101. Furthermore, the output side of the inverter 163 is connected to the exciting coil of the independent power supply relay 14 via one B contact point (●) of the system cutoff relay 13. Herein, as described above, the system input unit 103 is connected to the exciting coil of the system cutoff relay 13 via the B contact point (●) of the independent power supply relay 14, and the output side of the inverter 163 is connected to the exciting coil of the independent power supply relay 14 via the B contact point (●) of the system cutoff relay 13. Accordingly, a circuit constituted between the system cutoff relay 13 and the independent power supply relay 14, which are connected in an above-mentioned manner, constitutes a circuit (so-called an interlock circuit) in which, with respect to the system cutoff relay 13 and the independent power supply relay 14, priority is placed on a one-side relay that operates first (excitation), and the operation (excitation) of the other-side relay is prohibited.

Also, the inverter output confirmation port of the control unit 11 is connected via one A contact point (○) of the independent power supply relay 14, thereby constituting the closed circuit of the inverter output signal.

The engine driven heat pump 100 further includes a cooling fan 165 that cools the inverter 163 and a switching unit 166 that switches the presence and absence of the alternating current power from the input line of the battery charging circuit 162 to the cooling fan 165 (not illustrated in FIG. 2, see FIG. 3). The cooling fan 165 is arranged in the vicinity of the inverter 163 or contiguously arranged with the inverter 163 in such a manner as to send air the to the inverter 163. When the output power is outputted from the inverter 163, or/moreover when the peripheral temperature of the inverter 163 is equal to or higher than a predetermined temperature set in advance (for example, 30 degrees Celsius), the switching unit 166 is configured to supply the alternating current power from the input line of the battery charging circuit 162 to the cooling fan 165. In other words, only when the output power is not outputted from the inverter 163, and the peripheral temperature of the inverter 163 drops below the predetermined temperature (for example, 30 degrees Celsius), the switching unit 166 cuts off the supply of the alternating current power from the input line of the battery charging circuit 162 to the cooling fan 165.

More particularly, the switching unit 166 includes a cooling fan relay 166*a* that opens and closes in accordance with the presence or absence of the output power from the inverter 163 and a cooling fan switch 166*b* that opens and closes in accordance with the peripheral temperature of the inverter 163.

When the output power is not outputted from the inverter 163, the cooling fan relay 166*a* is configured to cut off the connection between the input line of the battery charging circuit 162 and the cooling fan 165, whereas when the output power is outputted from the inverter 163, the cooling fan relay 166*a* is configured to connect between the input line of the battery charging circuit 162 and the cooling fan 165 corresponding to the supply of the output power from the inverter 163 and supply the alternating current power from the input line of the battery charging circuit 162 to the cooling fan 165.

Specifically, the cooling fan relay 166*a* includes one A contact point (○). The exciting coil of the cooling fan relay 166*a* is connected to the output side (alternating current side) of the inverter 163. Accordingly, regarding the cooling fan relay 166*a*, when the output power is outputted from the inverter 163, the output power is supplied to the exciting coil, and the A contact point (○) is conducted (closed), whereas when the output power is not outputted from the inverter 163, the supply of the output power to the exciting coil is cut off, and the A contact point (○) is non-conducted (opened).

The cooling fan switch 166*b* includes a temperature block contact point that is closed when a temperature sensing unit reaches a predetermined temperature set in advance (for example, 30 degrees Celsius) or higher. When the temperature sensing unit is lower than the predetermined temperature (for example, 30 degrees Celsius), the temperature block contact point is opened, so that the cooling fan switch 166*b* cuts off the connection between the input line of the battery charging circuit 162 and the cooling fan 165, whereas when the temperature sensing unit is equal to or higher than the predetermined temperature (for example, 30 degrees Celsius), the temperature block contact point is closed, so that the cooling fan switch 166*b* connects between the input line of the battery charging circuit 162 and the cooling fan 165 and supplies the alternating current power from the input line of the battery charging circuit 162 to the cooling fan 165. The cooling fan switch 166*b* is arranged in the vicinity of the inverter 163 or contiguously arranged with the inverter 163 in such a manner as to respond to the peripheral temperature of the inverter 163.

Specifically, the cooling fan switch 166*b* includes one A contact point (○) (temperature block contact point). The cooling fan switch 166*b* includes the temperature sensing unit inclusive of a temperature sensor such as a thermistor and a switching unit inclusive of switchers such as an open/close relay, and the switching unit is closed in response to the signal from the temperature sensing unit when the temperature sensing unit reaches a predetermined temperature or higher, and the switching unit is opened in response to the signal from the temperature sensing unit when the temperature sensing unit senses a temperature lower than a predetermined temperature. The switching drive unit (specifically, exciting coil) of the switching unit is connected to the input line of the battery charging circuit 162 via the temperature sensing unit. Accordingly, regarding the cooling fan switch 166*b*, when the peripheral temperature of the inverter 163 is lower than a predetermined temperature (for example, 30 degrees Celsius), the supply of the alternating current power from the input line of the battery charging circuit 162 to the switching drive unit (specifically, exciting coil) of the switching unit is cut off and the A contact point (○) is non-conducted (opened), whereas when the peripheral temperature of the inverter 163 is equal to or higher than a predetermined temperature (for example, 30 degrees Celsius), the alternating current power is supplied from the input line of the battery charging circuit 162 to the switching drive unit (specifically, exciting coil) of the switching unit, and the A contact point (○) is conducted (closed). It is noted that, in the example, the cooling fan switch 166*b* is a temperature switch that uses the temperature sensing unit and the switching unit, but a thermostat-type temperature switch that does not require a power supply may be applied.

Then, the A contact point of the cooling fan relay 166*a* and the A contact point of the cooling fan switch 166*b* are connected in parallel, and the cooling fan 165 is connected to the input line of the battery charging circuit 162 via the A contact point of the cooling fan relay 166*a* and the A contact point of the cooling fan switch 166*b*, which are connected in parallel.

Herein, although not illustrated, a cross current prevention transformer is connected between the independent power supply relay 14 and a branch portion on the independent power supply relay 14 side of the output side of the inverter 163, and a circuit protector (CP: Circuit Protector) is provided between the independent output unit 101 and a branch portion on the independent output unit 101 side of the output side of the inverter 163.

It is noted that other circuit constitution with regard to the circuit constitution regarding circuit operations at the time of the self-sustaining operation has been described. Accordingly, its description is omitted. Also, the temperature open contact point 167*a* of the temperature switch 167, the abnormal-time-open contact point 168*a* of the battery charging circuit 162, and the signal generation contact point 163*a* of the inverter 163 will be described later.

Figure 4:
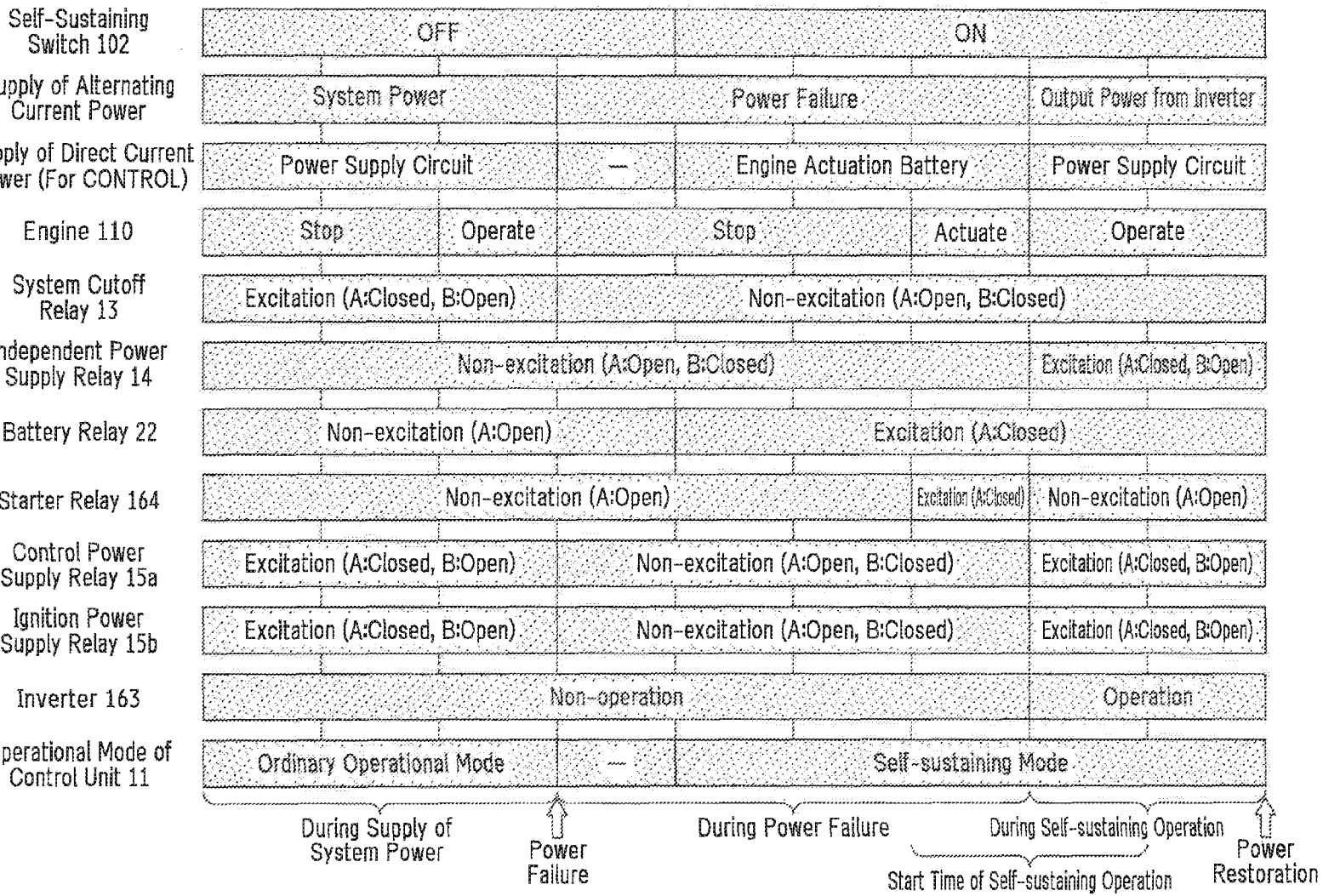
FIG. 4 is a timing chart illustrating the specific circuit operation of the engine driven heat pump according to the present embodiment.

FIG. 4 is a timing chart illustrating the specific circuit operation of the engine driven heat pump 100 according to the present embodiment.

In the engine driven heat pump 100 described above, at the time of the system power supply, the power failure, and the self-sustaining operation, the operational mode is represented as operational states illustrated in FIG. 4, regarding the self-sustaining switch 102, the supply of alternating current power, the supply of direct current power, the engine 110, the system cutoff relay 13, the independent power supply relay 14, the battery relay 22, the starter relay 164, the control power supply relay 15*a*, the ignition power supply relay 15*b*, the inverter 163, and the control unit 11.

Herein, the circuit operations of the engine driven heat pump 100 at the time of power failure and the self-sustaining operation will be described below, and the circuit operations of the engine driven heat pump 100 at the time of the system power supply and the like will be omitted. It is noted that the specification regarding Japanese Patent Application No, 2013493237, which has been filed by the applicant, discloses the circuit operations of the engine driven heat pump 100 at the time of the system power supply.

(Circuit Operations of Engine Driven Heat Pump at Time of Power Failure)

Regarding the engine driven heat pump 100, when the self-sustaining switch 102 is turned on by the user from a state where the power of the system E is cut off, the battery power from the engine actuation battery 161 is supplied to the exciting coil of the battery relay 22, and the A contact point (○) of the battery relay 22 is conducted. Subsequently, regarding the engine driven heat pump 100, the battery power from the engine actuation battery 161 is supplied to the power supply input port (specifically, the control power supply port and the ignition, power supply port) of the control unit 11 via the A contact point (○), which is in a conductive state with respect to the battery relay 22, and the B contact point (●), which is in a conductive state with respect to the input power supply relay 15 (specifically, the control power supply relay 15*a* and the ignition power supply relay 15*b*), and furthermore supplied to the exciting coil of the self-sustaining input relay 23 via the A contact point (○), which is in a conductive state with respect to the battery relay 22, and the A contact point (○) of the self-sustaining input relay 23 is conducted.

Accordingly, the battery power from the engine actuation battery 161 is supplied to the control unit 11, and the self-sustaining instruction port of the control unit 11 is conducted via the A contact point (○), which is in a conductive state with respect to the elf-sustaining input relay 23, so that the control unit 11 can receive the self-sustaining signal. Consequently, the control unit 11 enters the operational state and further can recognize that the self-sustaining switch 102 is turned on by the user and the self-sustaining operation is instructed.

Then, when the control unit 11 recognizes that the self-sustaining operation is instructed by the user, the control unit 11 switches the operational mode to the self-sustaining mode, the engine starting power is supplied from the engine starting output port to the exciting coil of the control relay 24 for a predetermined period of time, irrespective of the user's request for the heat pump operation (air conditioning in the example) (specifically, the transmission for a predetermined period of time (for example, five seconds) is repeated at predetermined times at predetermined intervals (for example, for every three seconds)), and the battery power from the engine actuation battery 161 is supplied to the exciting coil of the starter relay 164 via the A contact point (○) of the control relay 24. Accordingly, the A contact point (○) of the starter relay 164 is conducted for a predetermined period of time, and the battery power from the engine actuation battery 161 is supplied to the engine starter 140 via the A contact point (○) of the starter relay 164, thereby starting the engine 110 and starting the generator 130.

Also, regarding the engine driven heat pump 100, the output power from the generator 130 is supplied to the input side of the inverter 163 via, the generator controller 19, and the output power from the generator 130 is supplied to the internal instrument 21 via the generator controller 19 and the internal instrument power converter 20.

(Circuit Operations of Engine Driven Heat Pump at Time of Self-Sustaining Operation)

Regarding the engine driven heat pump 100, in a state of the circuit operation at which the generator 130 is actuated, when the control unit 11 transmits the output instruction signal from the inverter output instruction port to the signal input side of the inverter 163 after the establishment of the voltage of the generator 130 (when the voltage reaches a predetermined voltage or higher, or after a predetermined period of time has passed), and the inverter 163 is actuated, the output power from the inverter 163 is supplied to the exciting coil of the independent power supply relay 14 via the B contact point (●), which is in a conductive state with respect to the system cutoff relay 13, and the A contact point (○) of the independent power supply relay 14 is conducted, while the B contact point (●) of the independent power supply relay 14 is non-conducted. Accordingly, regarding the engine driven heat pump 100, the output power from the inverter 163 is supplied to the alternating current side of the power supply circuit 12, the input side of the starting transformer 17, the exciting coil of the input power supply relay 15 (specifically, the control power supply relay 15*a* and the ignition power supply relay 15*b*), and the input side of the battery charging circuit 162 via the A contact point (○), which is in a conductive state with respect to the independent power supply relay 14, and the A contact point (○) of the input power supply relay 15 (specifically, the control power supply relay 15*a* and the ignition power supply relay 15*b*) is conducted, whereas the B contact point (●) of the input power supply relay 15 is non-conducted.

Accordingly, in place of the battery power from the engine actuation battery 161, the engine driven heat pump 100 can supply the output power from the inverter 163 to the power supply input port of the control unit 11 (specifically, the control power supply port and the ignition power supply port) via the power supply circuit 12 and the A contact points (○), which is in a conductive state with respect to the input power supply relay 15 (specifically, the control power supply relay 15*a* and the ignition power supply relay 15*b*). Also, the engine driven heat pump 100 can supply the output power from the inverter 163 to the rectifier circuit 18 via the starting transformer 17 and supply the output power from the inverter 163 to the engine actuation battery 161 via the battery charging circuit 162. Also, the engine driven heat pump 100 can supply the output power from the inverter 163 to the exciting coil of the cooling fan relay 166*a* and supply the alternating current power from the input line of the battery charging circuit 162 to the cooling fan 165 via the A contact point (○) of the cooling fan relay 166*a*, or/furthermore, when the peripheral temperature of the inverter 163 is equal to or higher than a predetermined temperature (for example, 30 degrees Celsius), the engine driven heat pump 100 can supply the alternating current power from the input line of the battery charging circuit 162 to the cooling fan 165 via the A contact point (○) of the cooling fan switch 166*b*, thereby drivingly rotating the cooling fan 165 and cooling the inverter 163. Furthermore, the engine driven heat pump 100 can supply the output power from the inverter 163 to the outside of the engine driven heat pump 100 via the independent output unit 101 (in the example, the switching unit 410 of the self-sustaining switching device 400 (see FIG. 1)).

<Monitoring Constitution in which Occurrence of Abnormality of Self-Sustaining Device Used in Self-Sustaining Operation is Monitored>

Incidentally, when abnormality occurs in a self-sustaining device used in self-sustaining operation, it is impossible for the control unit 11 to detect the occurrence of abnormality in the self-sustaining device or for the user to recognize the occurrence of abnormality, unless the engine driven heat pump 100 includes the monitoring constitution in which the occurrence of abnormality of the self-sustaining device is monitored. Then, in view of simplification of the control constitution as much as possible, it is preferable that the control unit 11 include the smallest possible number of ports that detect the occurrence of abnormality in the self-sustaining device.

In this regards, the engine driven heat pump 100 according to the present embodiment provides the monitoring constitution in which the occurrence of abnormality in the self-sustaining device is monitored, as follows.

That is, the engine driven heat pump 100 according to the present embodiment includes the monitoring constitution in which the occurrence of abnormality is monitored with regards with a member associated with the fluctuation in the peripheral temperature of the inverter 163, the battery charging circuit 162, and the inverter 163, as the self-sustaining device wherein, the member associated with the fluctuation in the peripheral temperature of the inverter 163, for example, can be exemplified by the cooling fan 165, the switching unit 166 (in the example, the cooling fan relay 166*a* and the cooling fan switch 166*b*), a filter provided in the cooling fan 165, and a ventilating opening through which air sent from the cooling fan 165 to the inverter 163 is ventilated.

Figure 5:
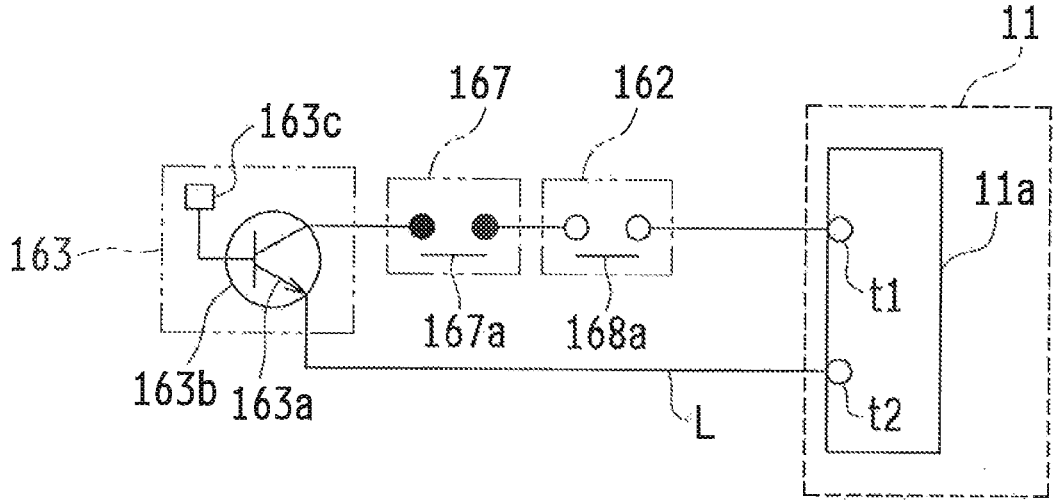
FIG. 5 is a schematic block diagram illustrating the connection state of a signal reception unit of a control unit to a temperature open contact point of a temperature switch, an abnormal-time-open contact point of a battery charging circuit, and a signal generation contact point of an inverter, with respect to the engine driven heat pump according to the present embodiment.

FIG. 5 is a schematic block diagram illustrating the connection state of the signal reception unit 11*a* of the control unit 11 with respect to the temperature open contact point 167*a* of the temperature switch 167, the abnormal-time-open contact point 168*a* of the battery charging circuit 162, and the signal generation contact point 163*a* of the inverter 163, in the engine driven heat pump 100 according to the present embodiment.

The engine driven heat pump 100 further includes the temperature switch 167 (not illustrated in FIG. 2, see FIGS. 3 and 5) that opens/closes in accordance with the peripheral temperature of the inverter 163.

In the temperature switch 167, the temperature open contact point 167*a* is provided that opens when a temperature sensing unit SN (see FIG. 3) reaches a predetermined temperature set in advance (for example, 50 degrees Celsius), or higher. More particularly, regarding the temperature switch 167, when the temperature sensing unit SN is lower than a predetermined temperature (for example, 50 degrees Celsius), the temperature open contact point 167*a* is closed, whereas when the temperature sensing unit SN is equal to or higher than a predetermined temperature (for example, 50 degrees Celsius), the temperature open contact point 167*a* is opened. The temperature switch 167 is arranged in the vicinity of the inverter 163 or contiguously arranged with the inverter 163 in such a manner as to respond to the peripheral temperature of the inverter 163.

Specifically, the temperature switch 167 includes one B contact point (●) (temperature open contact point 167*a*). The temperature switch 167 includes the temperature sensing unit SN inclusive of a temperature sensor such as a thermistor, and a switching unit RY (see FIG. 3) inclusive of switchers such as an open/close relay, and the switching unit RY is opened in response to the signal from the temperature sensing unit SN when the temperature sensing unit SN reaches a predetermined temperature or higher, and the switching unit RY is closed in response to the signal from the temperature sensing unit SN when the temperature sensing unit SN senses a temperature lower than a predetermined temperature. The switching drive unit (specifically, exciting coil) of the switching unit RY is connected to the input line of the battery charging circuit 162 via the temperature sensing unit SN. Accordingly, regarding the temperature switch 167, when the peripheral temperature of the inverter 163 is lower than a predetermined temperature (for example, 50 degrees Celsius), the supply of the alternating current power from the input line of the battery charging circuit 162 to the switching drive unit (specifically, exciting coil) of the switching unit RY is cut off, and the B contact point (●) (temperature open contact point 167*a*) is conducted (closed), whereas when the peripheral temperature of the inverter 163 is equal to or higher than a predetermined temperature (for example, 50 degrees Celsius), the alternating current power is supplied from the input line of the battery charging circuit 162 to the switching drive unit (specifically, exciting coil) of the switching unit RY, and the B contact point (●) (temperature open contact point 167*a*) is non-conducted (opened). It is noted that, in the example, the temperature switch 167 is a temperature switch that uses the temperature sensing unit SN and the switching unit RY, but a thermostat-type temperature switch that does not require a power supply may be applied.

Herein, modes where the peripheral temperature of the inverter 163 is increased, for example, include the rotational failure of the cooling fan 165 that cools the inverter 163, the failure of the switching unit 166 (in the example, the cooling fan relay 166*a* and the cooling fan switch 166*b*), the clogging of the filter (not illustrated) provided in the cooling fan 165, and the blockade of the ventilating opening (not illustrated) through which air sent from the cooling fan 165 to the inverter 163 is ventilated.

In the battery charging circuit 162, the abnormal-time-open contact point 168*a* (see FIGS. 3 and 5) is provided that opens when abnormality occurs in the battery charging circuit 162 (in the example, abnormality that the output power is not outputted from the battery charging circuit 162). More particularly, the engine driven heat pump 100 includes a switching unit 168 (see FIG. 3) inclusive of the abnormal-time-open contact point 168*a*. Regarding the switching unit 168, when the battery charging circuit 162 is normal (in the example, the output power from the battery charging circuit 162 is outputted), the abnormal-time-open contact point 168*a* is closed, whereas when abnormality occurs in the battery charging circuit 162 (in the example, abnormality that the output power is not outputted from the battery charging circuit 162), the abnormal-time-open contact point 168*a* is opened.

Specifically, the switching unit 168 is an output detection relay, operated in such a manner that, when the output power is provided from the output side of the battery charging circuit 162, the abnormal-time-open contact point 168*a* is closed, whereas when the output power is not provided from the output side of the battery charging circuit 162, the abnormal-time-open contact point 168*a* is opened. The switching unit 168 includes one A contact point (○) (abnormal-time-open contact point 168*a*). The exciting coil of the switching unit 168 is connected to the output side of the battery charging circuit 162. Accordingly, regarding the switching unit 168, when the output power is outputted from the output side of the battery charging circuit 162, the output power is supplied to the exciting coil, and the A contact point (○) (abnormal-time-open contact point 168*a*) is conducted (closed), whereas when the output power is not outputted from the output side of the battery charging circuit 162, the supply of the output power to the exciting coil is cut off, and the A contact point (○) (abnormal-time-open contact point 168*a*) is non-conducted (opened).

In the inverter 163, the signal generation contact point 163*a* (see FIGS. 3 and 5) is provided that generates a state signal P (see FIGS. 7A and 7B described later) indicating the state of the inverter 163. More particularly, the inverter 163 includes a signal generation switching element 163*b* (see FIG. 5) constituted by a semiconductor element and a control unit 163*c* (see FIG. 5) that performs the switching control of the signal generation switching element 163*b*. The signal generation contact point 163*a* is provided as the switching contact point of the signal generation switching element 163*b*, and under the control of the control unit 163*c*, when an ON signal that closes the signal generation contact point 163*a* is inputted from the control unit 163*c* to the signal generation switching element 163*b*, the signal generation contact point 163*a* is closed, whereas when an OFF signal that opens the signal generation contact point 163*a* is inputted, the signal generation contact point 163*a* is opened. The control unit 163*c* transmits the ON signal and the OFF signal to the signal generation switching element 163*b* in response to the state (normal state and abnormal state) of the inverter 163. Accordingly, the control unit 163*c* can open/close the signal generation contact point 163*a* in accordance with the state (normal state and abnormal state) of the inverter 163.

Specifically, the signal generation switching element 163*b* is an NPN bipolar transistor, and when the ON signal is inputted from the control unit 163*c* to the base side, the collector-emitter junction is conducted (closed), whereas when the OFF signal is inputted to to the base side, the collector-emitter junction is non-conducted (opened). It is noted that the signal generation switching element 163*b* may be a PNP bipolar transistor or a field effect transistor.

The control unit 11 is configured to include the signal reception unit 11*a* and detect whether a state between the bilateral terminals t1 and t2 (see FIG. 5) of the signal reception unit 11*a* is an open state or a short-circuit state, based on a signal received by the signal reception unit 11*a*. More particularly, the control unit 11 is configured to detect whether the state between the bilateral terminals t1 and t2 is the open state or the short-circuit state, in accordance with a voltage state between the bilateral terminals t1 and t2 of the signal reception unit 11*a*. Specifically, when the voltage between the bilateral terminals t1 and t2 of the signal reception unit 11*a* corresponds to a predetermined voltage (for example, DC 12V), the control unit 11 detects that the state between the bilateral terminals t1 and t2 corresponds to the open state, whereas when the voltage between the bilateral terminals t1 and t2 of the signal reception unit 11*a* is 0 V, the control unit 11 detects that the state between the bilateral terminals t1 and t2 corresponds to the short-circuit state.

Then, the temperature open contact point 167*a* of the temperature switch 167, the abnormal-time-open contact point 168*a* of the battery charging circuit 162, and the signal generation contact point 163*a* of the inverter 163 are connected in series with respect to the single signal reception unit 11*a* (port) of the control unit 11, thereby constituting a series circuit L (see FIG. 5).

Both ends of the series circuit L, in which the temperature open contact point 167*a* of the temperature switch 167, the abnormal-time-open contact point 168*a* of the battery charging circuit 162, and the signal generation contact point 163*a* of the inverter 163 are connected in series, are respectively connected to the bilateral terminals t1 and t2 of the single signal reception unit 11*a* (port) of the control unit 11. With the above-mentioned constitution, the engine driven heat pump 100 can constitute a closed circuit passing through the temperature open contact point 167*a*, the abnormal-time-open contact point 168*a*, and the signal generation contact point 163*a* with respect to the single signal reception unit 11*a* (port). Accordingly, the signal reception unit 11*a* of the control unit 11 can receive the state signal P generated at the signal generation contact point 163*a* of the inverter 163 by way of the temperature open contact point 167*a* of the temperature switch 167 and the abnormal-time-open contact point 168*a* of the battery charging circuit 162.

Figure 7A:
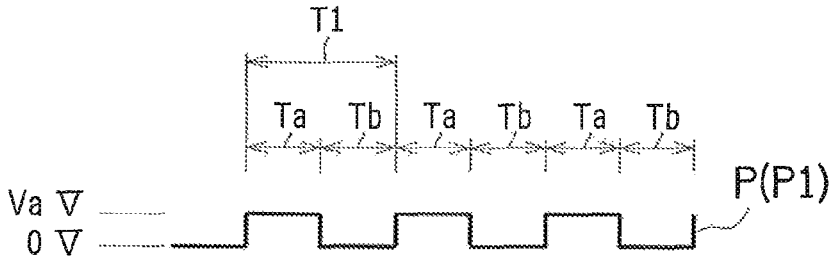
FIG. 7A is a timing chart illustrating one example of a signal received by the signal reception unit of the control unit and the timing chart illustrating a normal-time pulse signal.
Figure 7B:
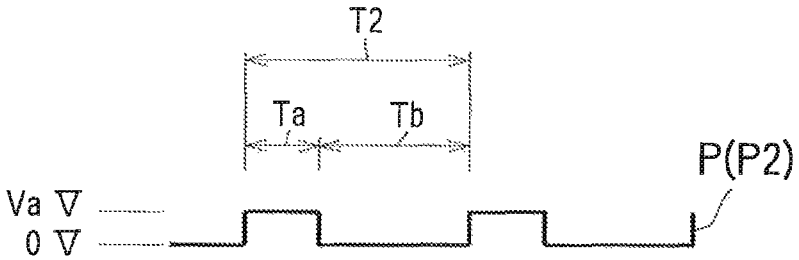
FIG. 7B is a timing chart illustrating one example of a signal received by the signal reception unit of the control unit and the timing chart illustrating an abnormal-time pulse signal.

The control unit 11 is configured that, when the signal reception unit 11*a* receives the state signal P generated at the signal generation contact point 163*a* of the inverter 163 (see FIGS. 7A and 7B), the control unit 11 detects that all the three of the member associated with the fluctuation in the peripheral temperature of the inverter 163, the battery charging circuit 162, and the inverter 163 are normal (see FIG. 7A), or the control unit 11 detects that the two of the member associated with the fluctuation in the peripheral temperature of the inverter 163 and the battery charging circuit 162 are normal, and that the inverter 163 is in an abnormal state (see FIG. 7B).

Also, the control unit 11 is configured that, when the signal reception unit 11*a* receives an abnormal-time-open signal Pa at which the voltage is always applied (specifically, a predetermined voltage Va is applied) (see FIG. 7C), the control unit 11 detects that at least one occurs, out of any of the abnormality of the member associated with the fluctuation in the peripheral temperature of the inverter 163 due to the opening of the temperature open contact point 167*a* of the temperature switch 167, the abnormality of the battery charging circuit 162 due to the opening of the abnormal-time-open contact point 168*a* of the battery charging circuit 162 (that is, the abnormality of the battery charging circuit 162, which is attributed to that the battery charging circuit 162 fails to output the output power in a normal manner), the abnormality of the inverter 163 (for example, the abnormality of the control unit 163*c* of the inverter 163 in which the signal generation contact point 163*a* is in a normal-time non-conduction state), and the disconnection of the series circuit L.

Also, the control unit 11 is configured that, when the signal reception unit 11*a* receives an abnormal-time short-circuit signal Pb at which the voltage is not applied in all times (specifically, a voltage is 0 V) (see FIG. 7D), the control unit 11 detects that at least one occurs, out of any of the abnormality of the inverter 163 (for example, the abnormality of the control unit 163*c* of the inverter 163 in which the signal generation contact point 163*a* is in a normal-time conduction state) and the short circuit between the bilateral terminals t1 and t2 of the signal reception unit 11*a* of the series circuit L.

In the present embodiment, the inverter 163 is configured to generate a pulse signal (a normal-time pulse signal P1 indicating that the inverter 163 is in a normal state) having a predetermined cycle set in advance at a normal time as a state signal P and generate a pulse signal (an abnormal-time pulse signal P2 indicating that the inverter 163 is in an abnormal state) having a predetermined cycle set in advance, which is different from that of the normal-time pulse signal (the normal-time pulse signal P1), corresponding to the abnormal state at the abnormal time.

Herein, for example, the states of the inverter 163 include a normal state, an abnormal state regarding the increase in temperatures of the inverter switching element, an abnormal state regarding the decrease in input voltages applied to inverter 163, an abnormal state regarding the increase in input voltages applied to inverter 163, an abnormal state regarding the increase in output currents of the inverter 163, and an abnormal state regarding the increase in output voltages of the inverter 163.

Figure 6A:
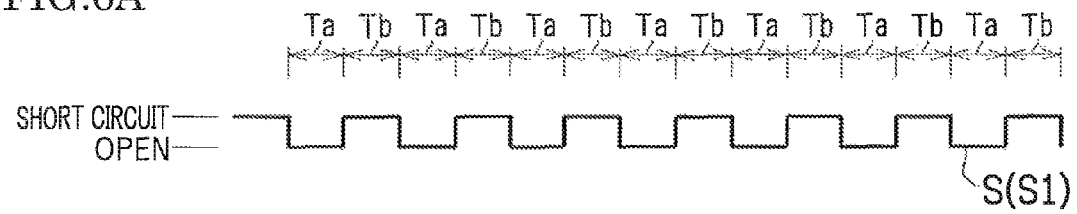
FIG. 6A is a timing chart illustrating one example of a short-circuit-and-open pattern illustrating a state where a series circuit passing through the temperature open contact point, the abnormal-time-open contact point, and the signal generation contact point is short-circuited or opened and the timing chart illustrating a normal-time short-circuit-and-open pattern.
Figure 6B:
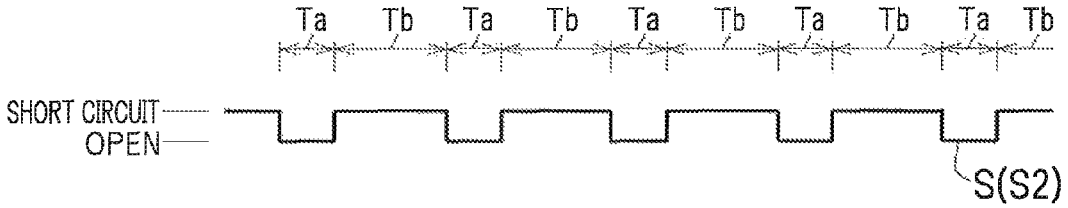
FIG. 6B is a timing chart illustrating one example of the short-circuit-and-open pattern illustrating the state where the series circuit passing through the temperature open contact point, the abnormal-time-open contact point, and the signal generation contact point is short-circuited or opened and the timing chart illustrating an abnormal-time short-circuit-and-open pattern.
Figure 6C:
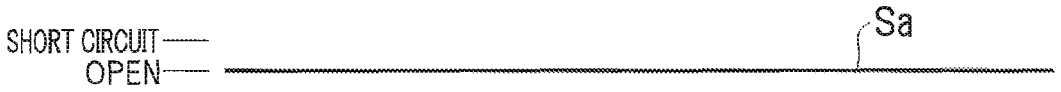
FIG. 6C is a timing chart illustrating one example of the short-circuit-and-open pattern illustrating the state where the series circuit passing through the temperature open contact point, the abnormal-time-open contact point, and the signal generation contact point is short-circuited or opened and the timing chart illustrating an abnormal-time open pattern.
Figure 6D:
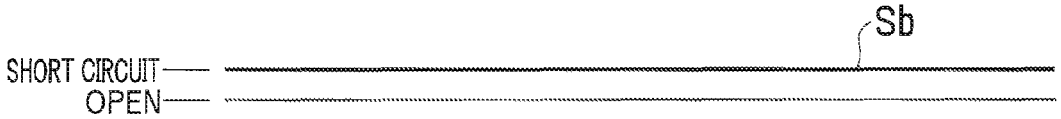
FIG. 6D is a timing chart illustrating one example of the short-circuit-and-open pattern illustrating the state where the series circuit passing through the temperature open contact point, the abnormal-time-open contact point, and the signal generation contact point is short-circuited or opened and the timing chart illustrating an abnormal-time short-circuit pattern.

FIGS. 6A to 6D are timing charts illustrating one example of a short-circuit-and-open pattern S illustrating a state in which the series circuit L passing through the temperature open contact point 167*a*, the abnormal-time-open contact point 168*a*, and the signal generation contact point 163*a* is short-circuited or opened. FIG. 6A illustrates a normal-time short-circuit-and-open pattern S1. FIG. 6B illustrates an abnormal-time short-circuit-and-open pattern S2. FIG. 6C illustrates an abnormal-time open pattern Sa. Also, FIG. 6D illustrates an abnormal-time short-circuit pattern Sb. It is noted that the abnormal-time short-circuit-and-open pattern S2 illustrated in FIG. 6B exemplifies the short-circuit-and-open pattern representing the abnormal state of the increase in the output voltage of the inverter 163 as an abnormal state.

Regarding the normal-time short-circuit-and-open pattern S1 illustrated in FIG. 6A, when the temperature open contact point 167*a* of the temperature switch 167 is closed (that is, the peripheral temperature of the inverter 163 is lower than a predetermined temperature, and the member associated with the fluctuation in the peripheral temperature of the inverter 163 is in a normal condition), and the abnormal-time-open contact point 168*a* of the battery charging circuit 162 is closed (that is, the battery charging circuit 162 outputs a normal output voltage and is in a normal condition), and the inverter 163 is in a normal condition, a short-circuit-and-open pattern is represented in which the signal generation contact point 163*a* is conducted or non-conducted at predetermined cycles based on the ON signal and the OFF signal from the control unit 163*c* of the inverter 163.

Regarding the abnormal-time short-circuit-and-open pattern S2 illustrated in FIG. 6B, when the temperature open contact point 167*a* of the temperature switch 167 is closed (that is, the peripheral temperature of the inverter 163 is lower than a predetermined temperature, and the member associated with the fluctuation in the peripheral temperature of the inverter 163 is in a normal condition), and the abnormal-time-open contact point 168*a* of the battery charging circuit 162 is closed (that is, the battery charging circuit 162 outputs a normal output voltage and is in a normal condition), and the inverter 163 is in an abnormal condition, a short-circuit-and-open pattern is represented in which the signal generation contact point 163*a* is conducted or non-conducted at predetermined cycles, which are different from those of the normal-time short-circuit-and-open pattern S1, based on the ON signal and the OFF signal from the control unit 163*c* of the inverter 163.

Regarding the abnormal-time open pattern Sa illustrated in FIG. 6C, when at least one of any abnormalities occurs, which include the opening of the temperature open contact point 167*a* of the temperature switch 167 (that is, the abnormality of the member associated with the fluctuation in the peripheral temperature of the inverter 163, which is attributed to that the peripheral temperature of the inverter 163 reaches a predetermined temperature or higher), the opening of the abnormal-time-open contact point 168*a* of the battery charging circuit 162 (that is, the abnormality of the battery charging circuit 162, which is attributed to that the battery charging circuit 162 does not output the output voltage in a normal manner), the abnormality of the inverter 163 (for example, the abnormality of the control unit 163*c* of the inverter 163 in which the signal generation contact point 163*a* is in a normal-time non-conduction state), and the disconnection of the series circuit L, the series circuit L falls into a normal-time open state.

Also, regarding the abnormal-time short-circuit pattern Sb illustrated in FIG. 6D, when at least one of any of the abnormality of the inverter 163 (for example, the abnormality of the control unit 163*c* of the inverter 163 in which the signal generation contact point 163*a* is in a normal-time conduction state) and the short circuit between the bilateral terminals t1 and t2 of the signal reception unit 11*a* of the series circuit L occurs, the series circuit L falls into a normal-time short-circuit state.

Figure 7C:
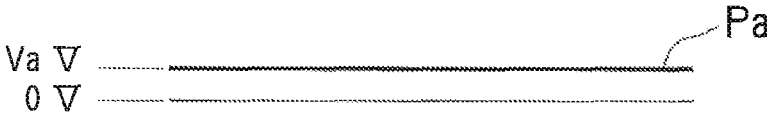
FIG. 7C is a timing chart illustrating one example of a signal received by the signal reception unit of the control unit and the timing chart illustrating an abnormal-time open signal.
Figure 7D:
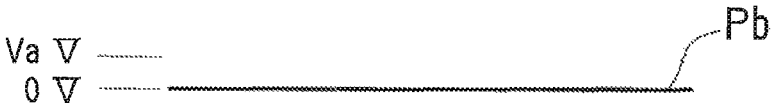
FIG. 7D is a timing chart illustrating one example of a signal received by the signal reception unit of the control unit and the timing chart illustrating an abnormal-time short-circuit signal.

FIGS. 7A to 7D are timing charts illustrating one example of a signal received by the signal reception unit 11*a* of the control unit 11. FIG. 7A illustrates the normal-time pulse signal P1. FIG. 7B illustrates the abnormal-time pulse signal P2. FIG. 7C illustrates the abnormal-time open signal Pa. Also, FIG. 7D illustrates the abnormal-time short-circuit signal Pb. It is noted that the abnormal-time pulse signal P2 illustrated in FIG. 7B exemplifies a pulse signal representing the abnormal state of the increase in the output voltage of the inverter 163 as an abnormal state.

As illustrated in FIGS. 7A to 7D, the normal-time pulse signal P1 is a pulse signal having a first cycle T1, which is a predetermined cycle, and the abnormal-time pulse signal P2 is a pulse signal having a second cycle 172, which is a predetermined cycle and different from the first cycle T1.

The first cycle T1 of the normal-time pulse signal P1 and the second cycle T2 of the abnormal-time pulse signal P2 are constituted by a predetermined open time Ta set in advance, which is represented as a time during which the bilateral terminals t1 and t2 of the signal reception unit 11*a* are in an open state, and a predetermined short-circuit time Tb set in advance, which is represented as a time during which the bilateral terminals t1 and t2 of the signal reception unit 11*a* are short-circuited.

In the first cycle T1 of the normal-time pulse signal P1, the open time Ta may be equal to or different from the short-circuit time Tb. Also, in the second cycle T2 of the abnormal-time pulse signal P2, the open time Ta may be equal to or different from the short-circuit time Tb.

The open time Ta of the first cycle T1 of the normal-time pulse signal P1 may be equal to the open time Ta of the second cycle T2 of the abnormal-time pulse signal P2. Also, the short-circuit time Tb of the first cycle T1 of the normal-time pulse signal P1 may be equal to the short-circuit time Tb of the second cycle T2 of the abnormal-time pulse signal P2.

When the open time Ta of the first cycle T1 of the normal-time pulse signal P1 is made equal to the open time Ta of the second cycle T2 of the abnormal-time pulse signal P2, the amount of the short-circuit time Tb of the second cycle T2 of the abnormal-time pulse signal P2 can be made different in respective abnormal states. Also, when the short-circuit time Tb of the first cycle T1 of the normal-time pulse signal P1 is made equal to the short-circuit time Tb of the second cycle T2 of the abnormal-time pulse signal P2, the amount of the open time Ta of the second cycle T2 of the abnormal-time pulse signal P2 can be made different in respective abnormal states. It is noted that, when the open time Ta and the short-circuit time Tb are different in the first cycle T1 of the normal-time pulse signal P1 and the second cycle T2 of the abnormal-time pulse signal P2, the short-circuit time Tb may be made longer than the open time Ta, or the open time Ta may be made longer than the short-circuit time Tb.

In the example, the open time Ta of the first cycle T1 of the normal-time pulse signal P1 is made equal to the open time Ta of the second cycle T2 of the abnormal-time pulse signal P2, and the amount of the short-circuit time Tb of the second cycle T2 of the abnormal-time pulse signal P2 is made different in respective abnormal states.

In the first cycle T1 of the normal-time pulse signal P1, the open time Ta is made equal to the short-circuit time Tb, and in the second cycle 12 of the abnormal-time pulse signal P2, the open time Ta is made different from the short-circuit time Tb. Also, in the second cycle T2 of the abnormal-time pulse signal P2, the short-circuit time Tb is made longer than the open time Ta. It is noted that, in the first cycle T1 of the normal-time pulse signal P1, the open time Ta is made different from the short-circuit time Tb, and with respect to the second cycle T2 of the abnormal-time pulse signal P2, in the second cycle T2 of any one of signals, the open time Ta may be made equal to the short-circuit time Tb, and in the second cycle T2 of the remaining signals, the amount of the short-circuit time Tb may be made different in respective abnormal states.

Specifically, the normal-time pulse signal P1 illustrated in FIG. 7A is provided as a signal that the open time Ta in the first cycle T1 is one second, and the short-circuit time Tb in the first cycle T1 is one second, based on the normal-time short-circuit-and-open pattern S illustrated in FIG. 6A. The abnormal-time pulse signal P2 illustrated in FIG. 7B is provided as a signal that the open time Ta in the second cycle T2 is one second, and the short-circuit time Tb in the second cycle T2 is n times second with respect to the open time Ta in the second cycle T2 (n is an integer of two or more, two seconds in the example), based on the abnormal-time short-circuit-and-open pattern S2 illustrated in FIG. 6B. Then, the second cycles T2 of the abnormal-time pulse signal P2 are longer than the first cycles T1 of the normal-time pulse signal P1. However, the second cycle T2 of the abnormal-time pulse signal P2 is not limited thereto, but may be shorter than the first cycle T1 of the normal-time pulse signal P1.

On the other hand, the abnormal-time open signal Pa illustrated in FIG. 7C is provided as a signal that a predetermined voltage Va is applied between the bilateral terminals t1 and t2 of the signal reception unit 11*a* in all times, based on the abnormal-time open pattern Sa illustrated in FIG. 6C. The abnormal-time short-circuit signal Pb illustrated in FIG. 7D is provided as a signal that the predetermined voltage Va is not applied between the bilateral terminals t1 and t2 of the signal reception unit 11*a* in all times, based on the abnormal-time short-circuit pattern Sb illustrated in FIG. 6D.

The control unit 11 is configured such that, when the signal reception unit 11*a* receives the normal-time pulse signal P1 generated at the signal generation contact point 163*a* of the inverter 163 (see FIG. 7A), the control unit 11 detects that all three of the member associated with the fluctuation in the peripheral temperature of the inverter 163, the battery charging circuit 162, and the inverter 163 are normal, and when the signal reception unit 11*a* receives the abnormal-time pulse signal P2 generated at the signal generation contact point 163*a* of the inverter 163 (see FIG. 7B), the control unit 11 detects that the member associated with the fluctuation in the peripheral temperature of the inverter 163 and the battery charging circuit 162 are normal, whereas the control unit 11 detects the abnormal states corresponding to the abnormal-time pulse signal P2 of the inverter 163 (for example, an abnormal state regarding the increase in temperatures of the inverter switching element, an abnormal state regarding the decrease in input voltages applied to inverter 163, an abnormal state regarding the increase in input voltages applied to inverter 163, an abnormal state regarding the increase in output currents of the inverter 163, an abnormal state regarding the increase in output voltages of the inverter 163, and the like).

As described above, according to the engine driven heat pump 100 of the present embodiment, the temperature switch 167 includes the temperature open contact point 167*a* that opens at a predetermined temperature (for example, 50 degrees Celsius) or higher, and the battery charging circuit 162 includes the abnormal-time-open contact point 168*a* that opens when abnormality occurs in the battery charging circuit 162, and the inverter 163 includes the signal generation contact point 163*a* that generates the state signal indicating the state of the inverter 163, and the temperature open contact point 167*a* of the temperature switch 167, the abnormal-time-open contact point 168*a* of the battery charging circuit 162, and the signal generation contact point 163*a* of the inverter 163 are connected in series with respect to the signal reception unit 11*a* of the control unit 11, so that the monitoring constitution can be provided wherein the occurrence of abnormality in the self-sustaining devices is monitored with regards with the member associated with the fluctuation in the peripheral temperature of the inverter 163, the battery charging circuit 162, and the inverter 163, each of which is used during the self-sustaining operation.

That is, the temperature open contact point 167*a*, the abnormal-time-open contact point 168*a*, and the signal generation contact point 163*a* are connected in series with respect to the signal reception unit 11*a* of the control unit 11, so that when the control unit 11 receives the state signal P, the control unit 11 can detect that all three of the member associated with the fluctuation in the peripheral temperature of the inverter 163, the battery charging circuit 162, and the inverter 163 are normal or detect that the two of the member associated with the fluctuation in the peripheral temperature of the inverter 163 and the battery charging circuit 162 are normal, and that the inverter 163 is in an abnormal state (that is, what abnormality occurs in the inverter 163).

Furthermore, when the control unit 11 cannot receive the state signal P, the signal reception unit 11*a* receives the abnormal-time-open signal Pa at which the voltage is always applied, so that the control unit 11 can detect that at least one occurs, out of any of the abnormality of the member associated with the fluctuation in the peripheral temperature of the inverter 163, which is attributed to that the peripheral temperature of the inverter 163 reaches a predetermined temperature or higher, the abnormality of the battery charging circuit 162 (that is, the abnormality of the battery charging circuit 162. Which is attributed to that the battery charging circuit 162 fails to output the output power in a normal manner), the abnormality of the inverter 163 (for example, the abnormality of the control unit 163*c* of the inverter 163 in which the signal generation contact point 163*a* is in a normal-time open state), and the disconnection of the series circuit L.

Alternatively, when the control unit 11 cannot receive the state signal P, the signal reception unit 11*a* receives the abnormal-time short-circuit signal Pb at which the voltage is not applied in all times, so that the control unit 11 can detect that at least one occurs, out of any of the abnormality of the inverter 163 (for example, the abnormality of the control unit 163*c* of the inverter 163 in which the signal generation contact point 163*a* is in a normal-time short-circuit state) and the short circuit between the bilateral terminals t1 and t2 of the signal reception unit 11*a* of the series circuit L.

Accordingly, the engine driven heat pump 100 can monitor the occurrence of abnormality with regards with the member associated with the fluctuation in the peripheral temperature of the inverter 163, the battery charging circuit 162, and the inverter 163 by means of the single signal reception unit 11*a* (port) of the control unit 11.

Also, in the engine driven heat pump 100 according to the present embodiment, the inverter 163 generates a pulse signal having a predetermined cycle at a normal time (the normal-tune pulse signal P1) as the state signal P and generates a pulse signal (the abnormal-time pulse signal P2) having a predetermined cycle, which is different from that of the normal-time pulse signal (the normal-time pulse signal P1), corresponding to the abnormal state at the abnormal time, so that, with the simple control constitution in which the pulse signal is generated, when the control unit 11 receives the normal-time pulse signal P1, it is determined that the member associated with the fluctuation in the peripheral temperature of the inverter 163, the battery charging circuit 162, and the inverter 163 are all normal, and when the control unit 11 receives a specific pulse signal (that is, the abnormal-time pulse signal P2), it is determined that the member associated with the fluctuation in the peripheral temperature of the inverter 163 and the battery charging circuit 162 are normal, while the abnormal state of the inverter 163 (for example, the abnormal state of the increase in the output voltage of the inverter 163) can be securely identified. Furthermore, when the control unit 11 does not receive the normal-time pulse signal P1 and the abnormal-time pulse signal P2 and receives the abnormal-time-open signal Pa or the abnormal-time short-circuit signal Pb, as described above, the control unit 11 can determine that at least one occurs, out of any of the abnormality of the member associated with the fluctuation in the peripheral temperature of the inverter 163, the abnormality of the battery charging circuit 162, the abnormality of the inverter 163, and the disconnection or short circuit of the series circuit L (that is, occurrence of abnormality at least in any one of the member associated with the fluctuation in the peripheral temperature of the inverter 163, the battery charging circuit 162, the inverter 163, and the series circuit L).

In the present embodiment, the engine driven heat pump 100 may include a notification device (for example, a display device that displays a message or a display device that lights an indicator) that notifies the occurrence of abnormality of the member associated with the fluctuation in the peripheral temperature of the inverter 163, the occurrence of abnormality of the battery charging circuit 162, the occurrence of abnormality of the inverter 163, the state of the inverter 163. Accordingly, this allows the user to recognize the occurrence of abnormality and the state of the inverter 163.

The present invention is not limited to the above-mentioned embodiments, but can be executed in various forms. Accordingly, the embodiments disclosed above are mere exemplification in all the aspects, but shall not be regarded as the basis of limitative interpretation. The scope of the present invention shall be defined based on Claims, not restricted by the main paragraph of Description. Furthermore, all the modifications and changes, which are included within the scope of the equivalents to Claims, are included in the scope of the present invention.

The invention claimed is:

1. An engine driven heat pump, comprising:

an engine;

a compressor configured to be driven by the engine;

a refrigerant circuit configured to flow a refrigerant sucked and discharged by the compressor;

a generator configured to be driven by the engine;

an engine actuation battery configured to actuate the engine;

a battery charging circuit configured to charge the engine actuation battery;

an inverter configured to convert output power from the generator into a predetermined voltage and a predetermined frequency;

a temperature switch configured to open and close in accordance with a peripheral temperature of the inverter; and a control device configured to include a signal reception unit, wherein a temperature open contact point configured to be opened at a predetermined temperature or higher is provided in the temperature switch, and wherein an abnormal-time open contact point configured to be opened when abnormality occurs in the battery charging circuit is provided in the battery charging circuit, and wherein a signal generation contact point configured to generate a state signal indicating a state of the inverter is provided in the inverter, and wherein the temperature open contact point of the temperature switch, the abnormal-time open contact point of the battery charging circuit, and the signal generation contact point of the inverter are connected in series with respect to the signal reception unit of the control device.

2. The engine driven heat pump according to claim 1, wherein the inverter generates a pulse signal having a predetermined cycle at a normal time as the state signal and generates a pulse signal having a predetermined cycle, which is different from the pulse signal at the normal time, corresponding to an abnormal state at an abnormal time as the state signal.

* * * * *